US005845866A

United States Patent [19]

Kaipf

[11] Patent Number: 5,845,866

[45] Date of Patent: Dec. 8, 1998

[54] METHOD FOR A REEL CHANGE IN A WINDING MACHINE, AND WINDING MACHINE SUITABLE FOR CARRYING OUT THE METHOD

[75] Inventor: Walter Kaipf, Haunsheim, Germany

[73] Assignee: Voith Sulzer Papier Maschinen GmbH, Germany

[21] Appl. No.: 654,279

[22] Filed: May 28, 1996

[30] Foreign Application Priority Data

May 26, 1995 [DE] Germany ..... 195 19 306.7

[51] Int. Cl.[6] ..... B65H 18/16; B65H 18/20; B65H 19/28; B65H 19/29

[52] U.S. Cl. ..... 242/521; 242/526.1; 242/530.4; 242/532.3; 242/580; 242/542

[58] Field of Search ..... 242/521, 526.1, 242/530.4, 532.3, 580, 541.4, 541.7, 542, 542.1, 542.2

[56] References Cited

U.S. PATENT DOCUMENTS

| | | | |
|---|---|---|---|
| 3,497,151 | 2/1970 | Voss et al. | 242/541.7 |
| 4,408,727 | 10/1983 | Dropczynski | 242/521 |
| 4,550,882 | 11/1985 | Hutzenlaub et al. | 242/580 |
| 4,775,110 | 10/1988 | Welp et al. . | |
| 5,092,533 | 3/1992 | Gangemi . | |
| 5,222,679 | 6/1993 | Dropczynski et al. | 242/521 |
| 5,360,180 | 11/1994 | Welp et al. | 242/530.4 |

FOREIGN PATENT DOCUMENTS

| | | |
|---|---|---|
| 0340337 | 4/1992 | European Pat. Off. . |
| 3611895 | 10/1987 | Germany . |
| 3611895 | 8/1991 | Germany . |
| 4034997 | 10/1993 | Germany . |
| 92 05100 | 4/1992 | WIPO . |

OTHER PUBLICATIONS

*Patent Abstracts of Japan,* vol. 016, No. 293 (M–1273), Jun. 29, 1992, & JP–A–04 080162, Mar. 13, 1992.

*Patent Abstracts of Japan,* vol. 006, No. 178, (M–155), Sep. 11, 1982 & JP–A–57 085749, May 28, 1982.

*Primary Examiner*—John M. Jillions

*Attorney, Agent, or Firm*—Ostrolenk, Faber, Gerb & Soffen, LLP

[57] ABSTRACT

A method for change a reel in a paper winding machine which has at least one carrier roll. The paper web (3) is fed to the carrier roll (1). It wraps around a portion of the circumference of the carrier roll and is wound onto a reel (3.1). Shortly before reaching a desired reel diameter, the machine speed (V) is reduced to a creep speed (k). Subsequently, a weakened line (8) running transversely across is formed on the web and, upstream of the weakened line, an adhesive is applied, while keeping the relative speeds of the web and the covering surface of the carrier roll (1) equal or close to one another. After the web is adhered to the reel (3.1), the reel is expelled or ejected, as a result of which the web is severed at the weakened line (8).

6 Claims, 4 Drawing Sheets

METHOD FOR A REEL CHANGE IN A WINDING MACHINE, AND WINDING MACHINE SUITABLE FOR CARRYING OUT THE METHOD

BACKGROUND OF THE INVENTION

The invention relates to a method for changing a reel in a paper winding machine. The invention also relates to a winding machine which operates in accordance with the method of the invention.

Prior art winding machines are described in:

(1) EP 0 340 337

(2) DE 36 11 895 C2 (=U.S. Pat. No. 4,775,110)

(3) DE 40 34 997 C2

(4) U.S. Pat. No. 5,092,533

Document (1) shows a winding machine having a central carrier roll and two outer carrier rolls arranged on opposed sides of the central carrier roll. The three carrier rolls form two winding beds for winding up a plurality of paper reels which are produced from longitudinally cut web parts or sections.

A reel change is carried out in the following way. As soon as the paper reels have been wound up with paper to a desired reel diameter, adhesive tracks are applied to the different web sections, at a reduced machine operating speed, to cause the last layer of paper to adhesively adhere to the underlying layer. Various severing devices are provided for the subsequent severing of the individual web sections. One type of severing device is pivotably mounted below the first winding bed, and the severing of the web parts is carried out by the act of ejecting the paper reel(s) from the winding bed onto a discharge table. The paper reels located in the second winding bed are first moved onto a discharge table, following which a severing device arranged in a recessed location in the discharge table is brought into an operating position. The severing is carried out in this position, for example by lowering the discharge table.

A disadvantages of the above embodiment ensues from the fact that, during the ejection of the paper reels from the winding beds, the web end which has just been adhesively glued could become detached. Another disadvantage is that the severing of the web sections is carried out at a relatively large distance behind the adhesion points. As a result, a long disattached tail hangs down loosely behind the adhesion point, in an undesired manner. It is often necessary to cut these loose web ends by hand or to glue them to the reels manually. Alternatively, an additional automatic device is needed to attach the long loose web ends to the reels.

The second document listed above shows and describes a method and a related winding machine with which the paper web is unwound from a supply reel and fed to a supporting roll. The supporting roll has a perforated roll cover and internally applied vacuum. The paper web wraps around the supporting roll over part of its circumference. At a specific point on the circumference of the supporting roll, it is wound onto a winding core to form a paper reel. When a reel has been wound to completion, a first glue track, running transversely to the running direction, is applied to the paper web. At a point following the glue track, a perforation line is formed on the web. Following the perforation line, another glue track, again running transversely to the paper web, is applied. Then, when the perforated, weakened zone has reached the supporting roll, the web supply is abruptly slowed (e.g. by braking the supply reel) and the web is therefore severed at the perforation line. The leading, first glue track serves to adhere the web end to the last paper layer on the finished reel. The second glue track serves the purpose of adhering the leading end of the web to a new winding core.

In the above described web severing process, the leading end of the web, i.e. the web leader, initially travels at a lower speed or is stationary, while the supporting roll under the web leader continues to rotate. This may be the reason for several problems noted in prior art machines using this process. One is that the web sometimes stops running in a straight line during the phase of completing the winding of a reel. Instead, it oscillates to and fro on the supporting roll. Also, there is the risk that, following the severing of the web, the leading end of the web will deviate laterally on the covering surface of the supporting roll, so that it arrives at the new winding core displaced laterally. The production of a satisfactory new reel is thus no longer assured. Furthermore, it is possible for the web to tear, not at the weakened zone, but rather in front of it, for example at the region where the web is running free, i.e. unsupported.

In the device of the third document, a weakening element which can be moved transversely over the entire web width while the machine is standing still, is pressed against the web, which is then resting on a supporting roll, in order to crush and thus weaken the web. This transverse movement requires a relatively long time. In addition, there the risk of damaging the surface of the supporting roll. The severing of the web is subsequently completed by increasing the web tension.

In the machine design according to document (4), web scoring elements which move transversely to the web running direction are provided for weakening the web and for applying adhesive thereto. During these processing steps, the machine must be stopped. This entails expenditures of time and money.

SUMMARY OF THE INVENTION

It is an object of the present invention to provide a method and a device which improves the operational reliability during reel changes in a paper winding machine.

It is a further object of the invention to provide a reel changing machine and process which retains a high level of operational reliability while performing the reel changing in as a rapid and automatic a manner as possible.

Yet another object of the invention is to provide a method and machine for reel changing in which the paper web can be directed along a straight line and be reliably guided at all times.

Yet another object of the invention is to provide a method and machine for winding up paper which produces a hanging trailing paper end which is as short as possible relative to the point where the trailing end is adhered to the roll of paper.

The present inventor has recognized that the cause of the deficiencies in the prior art machines can be attributed to the fact that the supporting roll continues to rotate while the new web leader remains essentially stationary, after the severing of the web. Therefore, the rotating supporting roll rubs against the paper web. As a result, unpredictable conditions prevail between the covering surface of the supporting roll and the web following the severing process, and lateral movement of the web often occurs.

According to the invention, it is ensured, not only during normal continuous operation, but also during a reel change, that all the rolls which contact the web run synchronously with the web, so that there is no significant relative speed differences between the covering surface of the carrier supporting roll and the web, during a reel change. A further important feature is that the web is only severed at the weakened, tearing line after the web has been adhered to the last layer of the reel(s). As a result, the new web leader is already located in the region of the winding bed at the moment of severing. All these measures contribute to the result that the new web leader can no longer move out laterally in relation to the new winding core. Another important advantage is that the perforation, i.e. weakening, of the paper web and the application of adhesive are not carried out with the aid of laterally moving elements. Also the machine is not at a standstill. Rather, it continues to run (preferably at a relatively low speed). As a result, an automatic reel change process is obtained which proceeds relatively rapidly.

The concept of the present invention can be used with winding machines of different constructions. These include winding machines which have only one supporting roll (as in document (2), FIG. 1), and winding machines having two or three carrier rolls, which operate in pairs to form one or two winding beds. In the last-mentioned case, a compressed air cushion can be built up in the winding bed to relieve the dead weight of the paper reel(s) being produced in the winding bed. For this purpose, the present invention provides a sealing arrangement which can be moved from below into a position between the two carrier rolls. The structural configuration of such a sealing arrangement is significantly facilitated by the use of the method of the invention which severs the paper web during a reel change. This is because a severing device such as is disclosed in document (1) is no longer required. Thus, the need to take into account a movable severing device has been avoided.

The preferred field of application of the invention is with winding machines (with or without longitudinal cutting devices) which are operated "off-line", i.e. independently of the paper-making machine. This allows the winding machine speed to be higher than that of the paper-making machine. The very high winding machine speed does require the winding machine speed to be temporarily reduced during a reel change to a creep speed. However, the invention may also be used with relatively slower running winding machines, in which a reduction in the machine speed during a reel change is not necessary. Such a winding machine may operate "on-line" with a similar, relatively slow running paper-making or board-making machine.

To further improve the operational reliability of the winding machine, the operating speed of the winding machine can be reduced still further and gradually after reaching the creep speed. For example, it is advantageous in many cases to reduce the operating speed to zero or close to zero during the ejection of the reels. However, if it is desired that the entire reel change process should proceed especially fast, it is then possible—provided that the weakened line has been made and the adhesive has been applied—to keep the creep speed essentially constant. It is also possible to allow the winding machine to continue to run slowly, if necessary, during the ejection of the reel(s).

The ejection of the reel(s) is preferably only initiated when the adhesive tracks have reached the reel(s), so that the tail end of the web is preferably stuck to the reel. Alternatively, it is also possible to initiate the ejection of the reel(s) shortly before this event, so that adhering of the web tail is carried out during the ejection process.

All the different method variations of the invention can be still further refined by assuring that the free web ends located on the finished reels behind the adhesion points are particularly short or entirely eliminated. In other words, the weakened line directly follows the adhesive tracks. In this case, it is in principle of no importance whether the application of the adhesive is carried out before or after or at the same time as the making of the weakened line. However, the adhesive dispenser is preferably arranged downstream of the weakening device (in relation to the web running direction), so that the weakening, or scoring device is not contaminated with adhesive.

BRIEF DESCRIPTION OF THE DRAWINGS

The invention is explained below in greater detail with reference to the drawing, in which.

DETAILED DESCRIPTION OF VARIOUS EMBODIMENTS OF THE INVENTION

Figure 1:
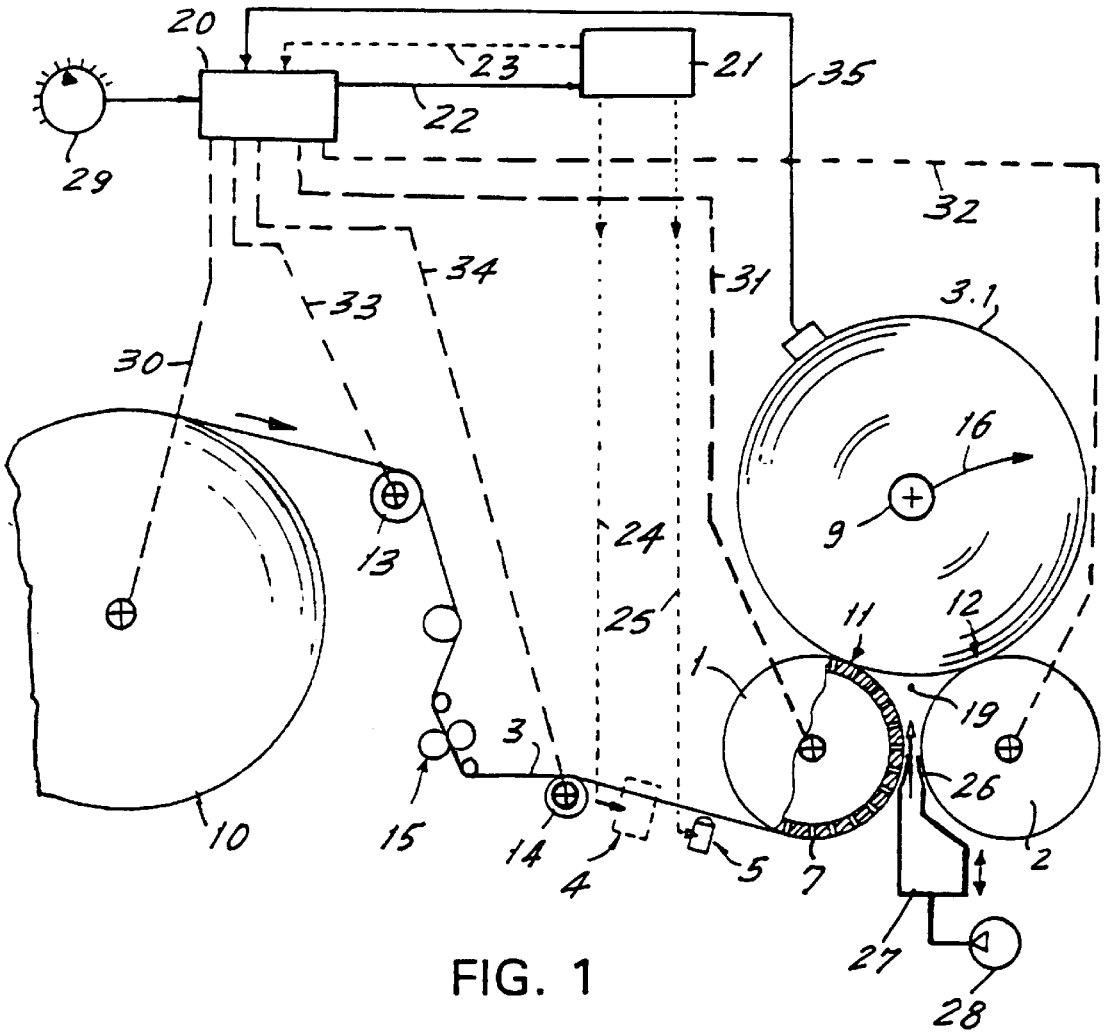
FIG. 1 schematically shows a reel cutting system having a carrier roll winding machine.

FIG. 1 shows a carrier roll winding machine having two carrier rolls 1 and 2, which form a winding bed 19. The carrier roll 1 has a perforated roll cover, and an interior which can be connected to a source of vacuum. A paper web 3 arriving, for example, from an unwinding station, which typically includes a supply reel 10, proceeds over guide rolls 13, 14 and is led, by being guided from below, onto the carrier roll 1. The web wraps around and over a part of the circumference of the roll 1 and is wound up on a winding core 9 to form a paper reel 3.1 (or to form a plurality of paper reels 3.1, if a longitudinal cutting device 15 is activated). Alternatively, the web may be fed not from the unwinding station but in real time, directly from a paper-making machine (not shown).

The schematically indicated perforating device 4, which is preferably designed according to German Utility Model 29508732, the content of which are incorporated by reference herein, can be included to constituent part of the present invention. Also included is an adhesive dispenser 5, which is one of a plurality of adhesive dispensers which are arranged in a row across the width of the paper web 3. A conveyor belt 7 which is used after changing of the supply reel 10, serves for threading-in a new web end, i.e. a leader.

As schematically illustrated, each of the supply reel 10, the carrier rolls 1 and 2 and, for example, the guide rolls 13 and 14 are provided with a respective drive, each of which is connected via a respective control line 30 to 34 to a central drive control unit 20. This ensures that all the driven rolls continuously rotate approximately synchronously, namely at a desired web speed, controllable by means of a desired speed setting transmitter 29.

Figure 2:
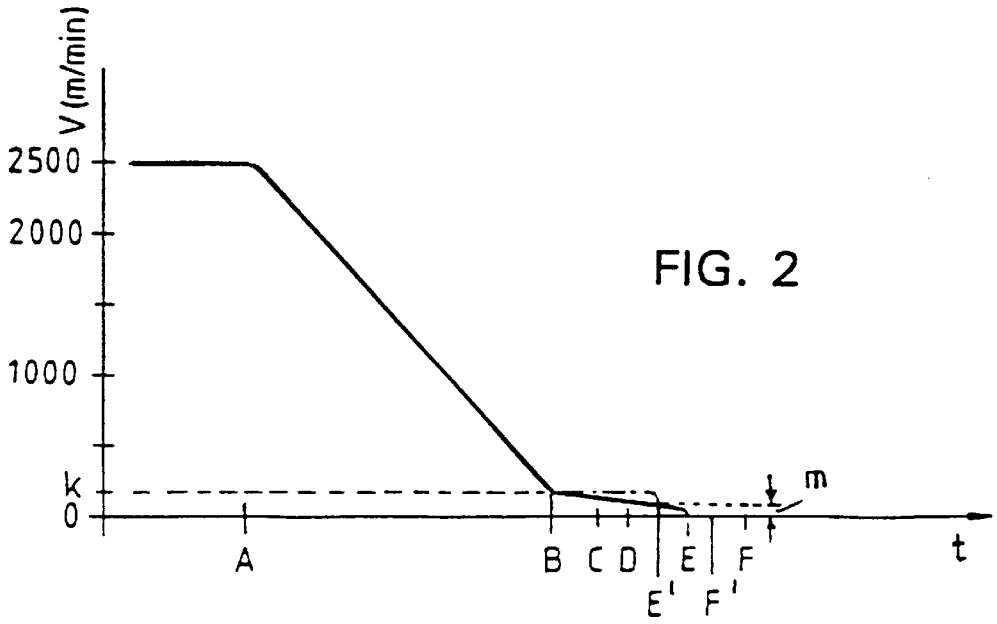
FIG. 2 shows the operating speed variations over time during the reel change.
Figure 3:
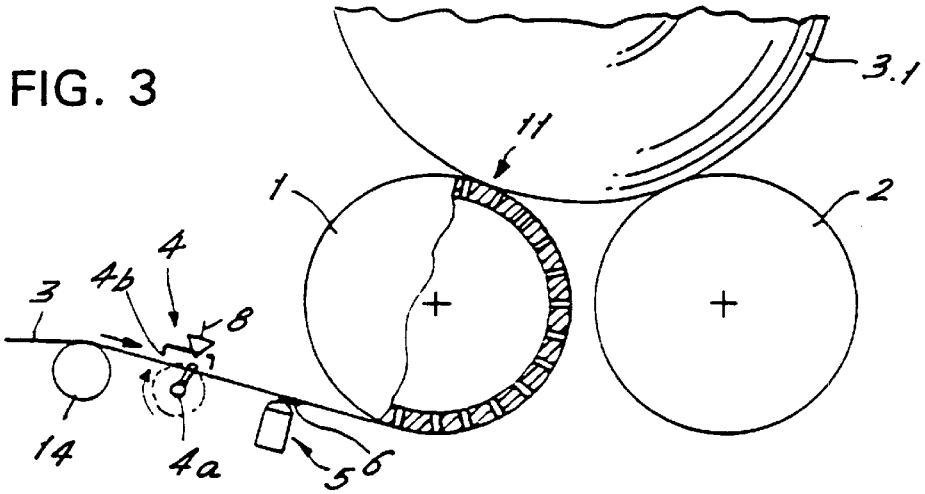
FIGS. 3 to 5 show the sequential steps of the reel change over time for the winding machine of FIG. 1.
Figure 4:
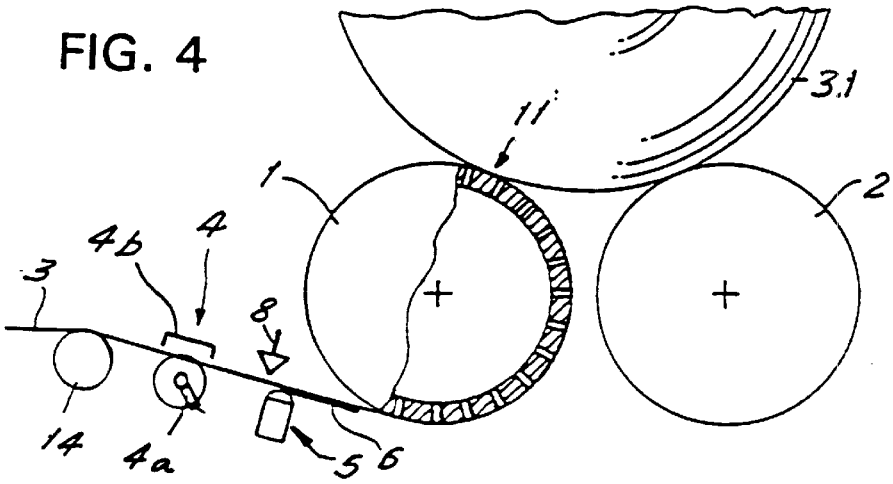
Figure 5:
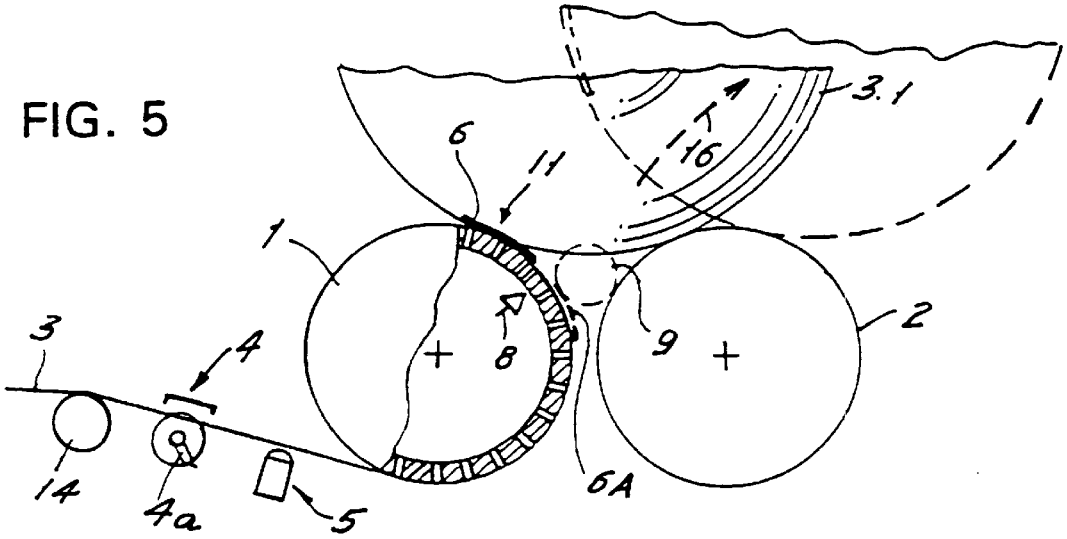

The process of changing a reel is controlled as follows. When the newly wound paper reel(s) 3.1 has (or have) achieved a desired reel diameter, a signal is sent to the drive control unit 20 via line 35. In response, the control unit 20 begins reducing the operating speed V from, for example, 2500 m/min to a creep speed k of well under 500 m/min as shown in FIG. 2. All of the drives continue to run in synchronism with the web. Then, via line 22, a control unit 21 is activated which, in turn, activates via the lines 24, 25 the perforation device 4 and the adhesive dispensers 5, either simultaneously or one after the other. At a specific time thereafter, for example when the applied adhesive 6 has reached the paper reel 3.1 (FIG. 5), a signal transmitted via line 23 initiates a further slowing down or the stopping of all the drives. The paper reel(s) 3.1 are then ejected as indicated by arrow 16, whereby the paper web is then severed at its weakened tearing line formed by the perforating drive 4 (FIGS. 3–5). If desired, the reel change process can be initiated before the normal desired diameter of the paper reel(s) is reached. Note that in machines that run relatively slowly, the steps of reducing the operating speed may be omitted.

The invention also includes the concept of building up a compressed air cushion in the winding bed 19, in order to counteract the dead weight of the paper reel(s) 3.1. In this manner, the loading of the paper web at the contact points 11 and 12 is intended to be reduced. For this purpose, the winding bed 19 is sealed off at the bottom by means of a seal arrangement 26 (FIG. 1). In the illustrated embodiment, the seal is a constituent part of a compressed air box 27, which is connected to a source 28 of compressed air. For cleaning or removing paper broke, the seal arrangement 26, 27 can be lowered. The compressed air cushion produced in the winding bed 19 is additionally sealed off to the outside via side shields (not shown).

As already noted, FIG. 2 shows that the overall reel changing system has an operating speed of, for example, 2500 m/min during normal operation. At a time A, when the reel 3.1 has just about reached its desired diameter, the operating speed begins to reduce so as to reach a creep speed k (for example 200 m/min) by the time B. This creep speed remains constant for a time, as shown by a dash-dotted line, or it is gradually reduced still further. At the time B, the weakening device, for example the perforating device 4, is set going. The device 4 can be constructed as a shaft which extends over the entire web width and which has a perforation comb which is able to carry out a single revolution. Thereby, the perforation comb penetrates into the web 3 to produce the weakened point 8, in the form of a row or line of perforations, as shown in FIG. 11.

Figure 11:
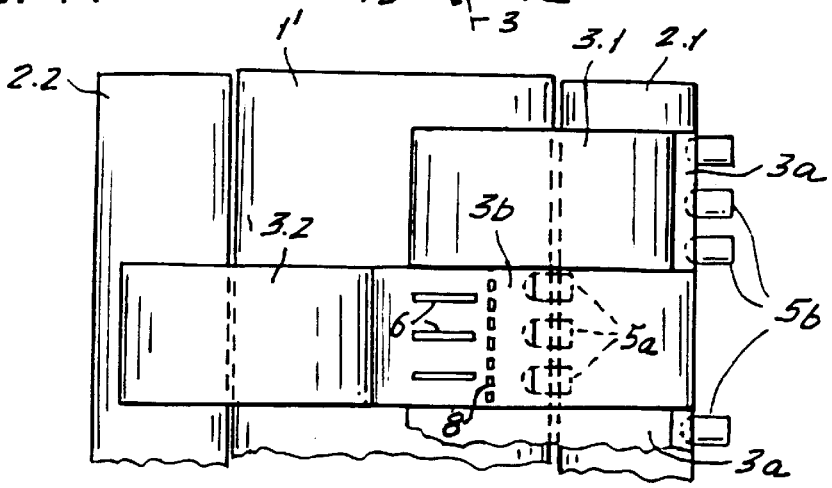
FIG. 11 is a top view of the winding machine according to FIG. 10.

Shortly thereafter, at the time C, the adhesive dispensers 5 are activated until the time D, to apply a plurality of adhesive tracks 6 to the paper web 3 (FIG. 11). At the time E, the entire reel cutting system can, for example, be stopped. Directly thereafter (at time F), the ejection of the reel(s) 3.1 is carried out, resulting also in the web being severed along the weakened tearing point or line 8. If the creep speed k remains constant after the time B, stopping occurs still earlier, that is at time E'. Likewise, the ejection of the reel(s) occurs earlier, at time F'. Further speeding up of the entire process can be achieved by running the machine slowly, even during the ejection of the reel(s) and during the subsequent insertion of the new winding cores 9 (FIG. 5), for example, by running at the speed m, which is less than the creep speed k.

Various stages of the above described process are illustrated in FIGS. 3 to 5. Thus, in FIG. 3, the tearing line 8 has just been produced. The perforation device 4 is shown disengaging from the web 3, and then coming to its rest position (FIGS. 4 and 5). In FIGS. 3 to 5, movement of the tearing line 8 is identified by the arrows 8 in FIGS. 3–5. Thus, FIG. 3 shows the state at time C (FIG. 2), when the adhesive dispensers 5 have just begun to apply adhesive tracks 6 to the paper web 3. FIG. 4 shows the state at the time D of FIG. 2. Here, the tearing line 8 has first arrived at the adhesive dispensers 5. Application of the adhesive is therefore now terminated.

The distance from the end of the adhesive tracks 6 to the tearing line 8 is therefore very small; it can be equal to almost zero. In this way it is possible for the free web end located behind the adhesive point to be extremely short. FIG. 5 shows the state at the time E (or shortly before this time). The adhesive tracks 6 have by now run partly (or completely) through the contact point 11 of the web, at the nip point between the paper reel 3.1 and the carrier roll 1. At this point, the web has been stuck to the previous web layers on the paper reel 3.1, just ahead of the tearing line 8.

At this time, the machine is slowed further or is stopped. The paper reels 3.1 are ejected. The new web end or leader, produced by the severing of the web, is securely held on the roll cover under the effect of the subatmospheric (vacuum) pressure which prevails in the interior of the perforated carrier roll 1. Thus, following the insertion of a new winding core 9, the next winding process can begin. The new winding core 9 normally has an adhesive on its surface to which the new web leader sticks. Alternatively, it is possible to apply an additional series of adhesive tracks 6A (see FIG. 5) to the paper web 3 downstream of the tearing line 8, by using the adhesive dispensers 5.

Figure 6:
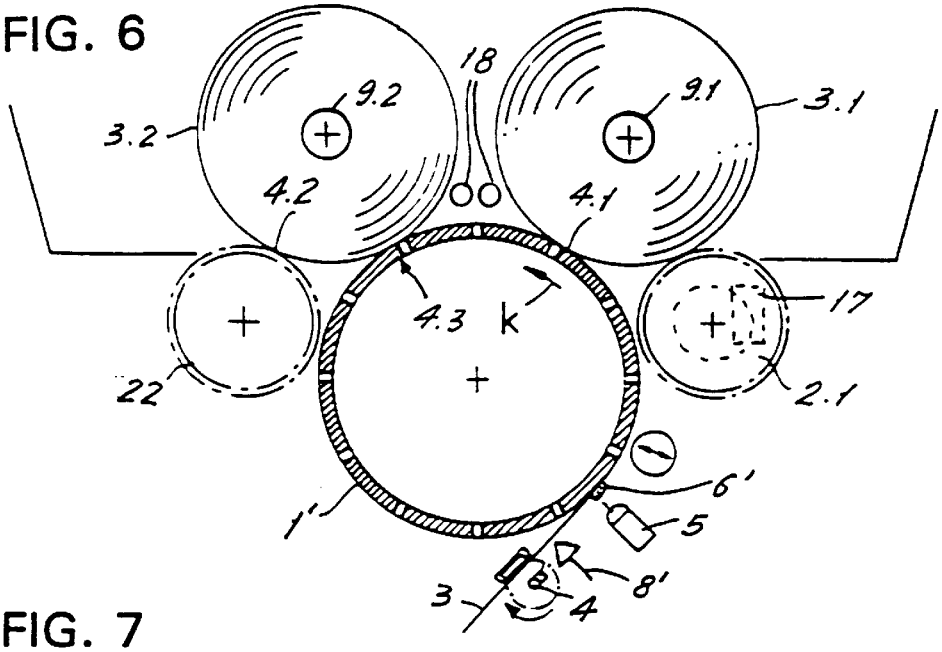
FIGS. 6 to 8 show the sequential steps of the reel change of a winding machine having three carrier rolls.
Figure 7:
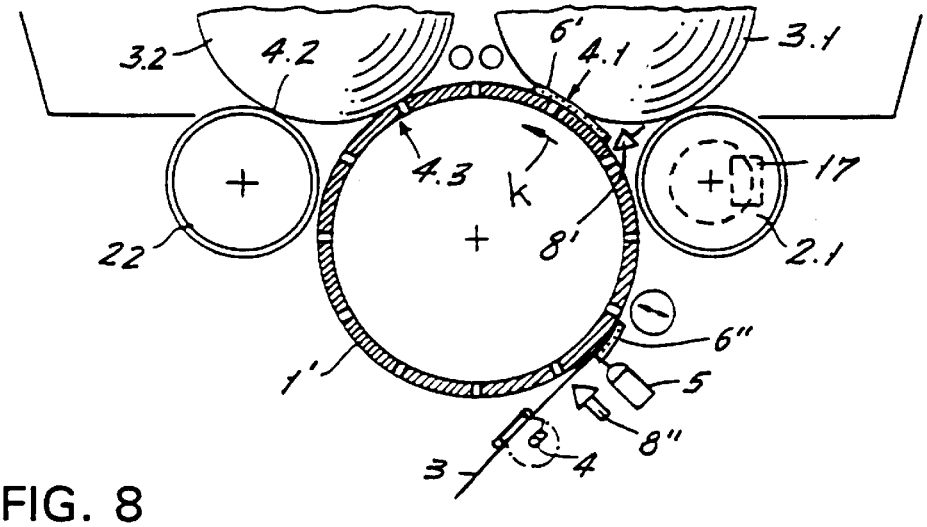
Figure 8:
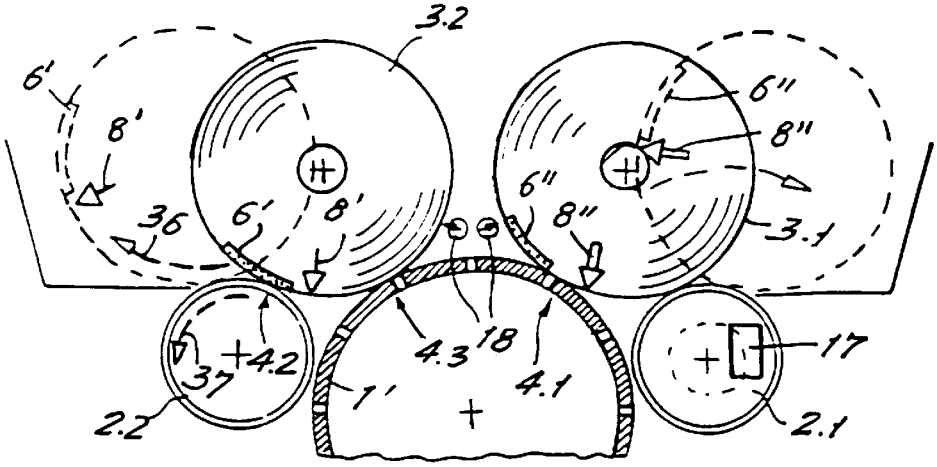

The embodiment of the invention according to FIGS. 6–8 comprises a carrier roll winding machine having a central carrier roll 1' and having two outer carrier rolls 2.1 and 2.2 arranged on opposed sides of the central carrier roll 1'. Two winding beds are thus formed, one of which accepts a paper reel 3.1 (including one or more coaxially extending reels) and the other of which similarly accepts at least one paper reel 3.2. Each reel has a respective winding core 9.1, 9.2. In this machine, the paper web 3 is divided by longitudinal cutters (not shown) into a number of longitudinal web sections, which run over the central carrier roll 1'. Seen from a top view of the machine, these web sections are wound up alternately in the left and in the right winding bed (similar to FIG. 11). Each paper reel 3.1, 3.2 is guided in a known manner by means of guide heads, not shown, which engage the cores 9.1, 9.2. Each web part or section is assigned one or more adhesive dispensers 5 (or 5*a*, 5*b*). The perforating device 4 extends over the entire machine width. Each paper reel 3.1, 3.2 is assigned an ejection device 18 (shown symbolically). The machine operates essentially like the double carrier roll winding machine according to FIG. 1–5, but with the following differences.

In FIG. 6, the machine runs at a creep speed k. The instant, i.e. the time, at which a first tearing line 8' is made is shown by the arrow 8'. The adhesive dispensers 5 are just beginning to apply adhesive 6' to the web section travelling towards the paper reel 3.2. FIG. 7 illustrates the machine condition at a later time, at which the applied adhesive 6' and the first tearing line 8' move past the reel 3.1.

A second tearing line 8" is now produced on the web and the adhesive dispensers 5 assigned to the other web section (of reel 3.1) are activated, producing further adhesive tracks 6". In FIG. 8, the tearing line 8' has just reached the contact point 4.2 of the reel 3.2 on the second outer carrier roll 2.2. The distance between the tearing lines 8' and 8" is selected such that the second tearing line 8" reaches the contact point 4.1 of the reel 3.1 on the central carrier roll 1' at the same time.

In the process, the web ends have already been stuck to the reels. The machine has been stopped (or is running at a further reduced speed m). The ejection of the reels 3.1 and 3.2 with the aid of the ejection devices 18 is carried out in the present embodiment in a different manner as follows. On the first outer carrier roll 2.1 a brake 17 is activated. Therefore, the clockwise rotating reel 3.1 is caused to roll over the stopped carrier roll 2.1 during the ejection. By contrast, the second outer carrier roll 2.2 continues to freely rotate, so that during the ejection of the reel 3.2, the reel 3.2 and the roll 2.2 roll on each other like a rotating gear wheel pair (shown symbolically by the arrows 36 and 37). In both cases, a large longitudinal tension is produced in the web in the region of the tearing lines 8' (on the reel 3.2) and 8" (on the reel 3.1), respectively, during the ejection of the reel(s), so that the web is satisfactorily and reliably severed. The fact that the first tearing line 8' is also present in the web part for the reel 3.1 causes no disturbance.

The exemplary embodiment shown in FIGS. 6 to 8 can be modified as follows. The outer carrier rolls 2.1 and 2.2 can be omitted (as indicated in FIG. 6 with dash-dotted lines). In this case, the paper reels 3.1 and 3.2 are held in their position on the carrier roll 1' only by means of guide bearings (not shown) which engage the cores 9.1 and 9.2. The manner of producing the tearing lines 8' and 8" and applying the adhesive 6' and 6" is in principle carried out exactly as described above. It is only necessary for the distance between the tearing lines 8' and 8" to be provided closer than in FIGS. 7 and 8. This is because the ejection of the reels 3.1 and 3.2 is preferably carried out when the tearing line 8" is located a short distance upstream of the contact point 4.1 (exactly as in FIG. 8) and when at the same time the tearing line 8" (differing from FIG. 8) is located a short distance upstream of the contact point 4.3 of the reel 3.2 on the carrier roll 1'.

Figure 9:
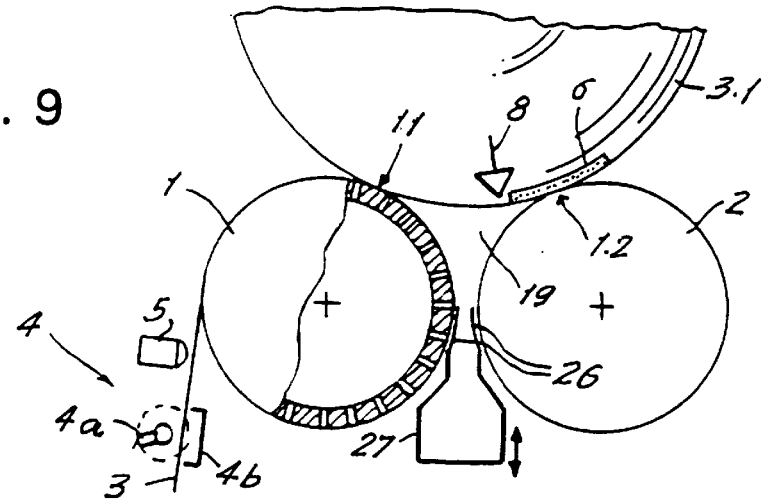
FIG. 9 shows an alternative to the embodiment of FIG. 5.

FIG. 9 shows a double carrier roll winding machine in which the paper web 3 enters the winding bed not from below but from above (travelling clockwise on the carrier roll 1). In this case, the first carrier roll 1 can optionally be designed as a non-perforated, i.e. as a normal non-vacuum, roll. The state shown is that at time E, at which the machine is at a standstill. The applied adhesive 6 and the tearing line 8 have passed beyond the contact point 11 reaching the region of the contact point 12, so that the ejection of the reel(s) 3.1 is now carried out over the carrier roll 2. In this case, the carrier roll 2 can be allowed to rotate freely; that is to say the same method can be used as in the case of the reel 3.2 and the carrier roll 2.2 of FIG. 8. Differing from FIG. 9, the ejection of the reel(s) 3.1 can also be carried out earlier, when the tearing line 8 has reached the region of the contact point 11.

As has already been explained with reference to FIG. 1, a compressed air cushion can be built up in the winding bed 19. The arrangement according to FIG. 9 is particularly suitable for relatively impervious paper grades, since no air can penetrate between the paper layers from the compressed air cushion, as a consequence of the running of the paper web from above into the winding bed 19. This is different from FIG. 1. In FIG. 1, it is possible for air to pass between the layers of the paper web from the compressed air cushion at the gap 11. In the case of impervious paper grades this produces the risk that the outer layers run out laterally, i.e. become separated, and/or a bubble is produced upstream of the contact point 12. In the case of thin, porous paper grades, on the other hand, this risk does not exist, since any air which has penetrated can escape.

Figure 10:
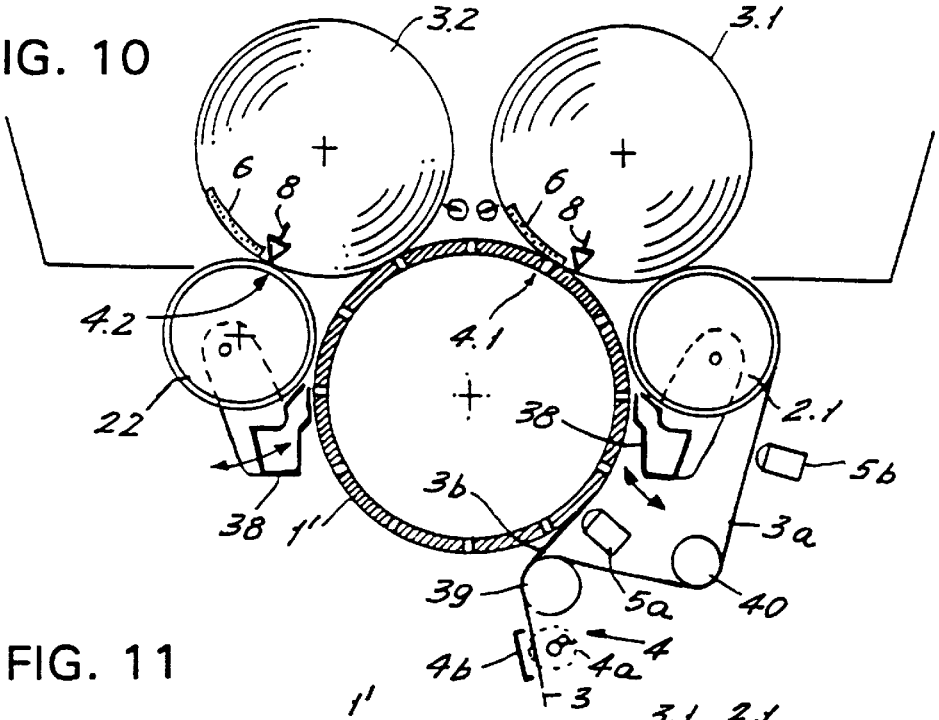
FIG. 10 shows an alternative to the embodiment of FIG. 8.

FIGS. 10 and 11 show a modification of the winding machine of FIGS. 6 to 8. Devices 38 (seals with compressed air feeds) have been added for the production of compressed air cushions under the winding rolls 3.1 and 3.2. In order that not only the web section running toward the reel 3.2 but also the web section moving toward the reel 3.1 should approach the winding bed from above, the web sections are severed downstream of the weakening device 4 on a guide roll 39. From here, the web section **3*a* runs over a further guide roll 40 toward the carrier roll 2.1, while the other web section 3*b* runs directly as before onto the central carrier roll 1'. Each web section 3*a*, 3*b* has assigned to it a number of adhesive dispensers 5*b* and 5*a*. Under favorable geometric relationships, it is sufficient to provide a single tearing line 8 over the entire web width in the web sections (instead of two tearing lines 8' and 8" located following one another, as in FIGS. 7 and 8). This is possible if the tearing lines 8 are made such that the web sections pass approximately simultaneously into the vicinity of the contact points 4.1 and 4.2, respectively. In this case, the distance between the two tearing lines is about equal to the difference between the two web running paths, $L_1$ and $L_2$, of the web sections 3*a* and 3*b*. $L_1$ is the running path from the weakening device (4) to the region of the first winding bed and $L_2$ is the running path from the weakening device (4) to the region of the other winding bed. As already explained with reference to FIG. 9, the arrangement according to FIG. 10** can be used universally—when using the compressed air relief method—that is to say even for the processing of relatively impervious paper grades.

In all the exemplary embodiments, the weakening device 4 is preferably designed as a perforating device according to German Utility Model 295 08 732.3. The essential parts of this device include a shaft having a perforation comb **4*a*, which penetrates into the web during each revolution of the shaft. In this case, the web is supported, for example, by a groove-shaped, web supporting device 4*b***, without the perforation comb coming into contact with the web supporting device. This design increases the operational reliability during a reel change, since the perforation line can be made in the web at a precisely determinable point, while the machine continues to run. The risk of premature total tearing of the web is reliably avoided.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of changing a reel in a paper winding machine which includes at least one carrier roll, said paper winding machine operating at a normal speed (V), the method comprising the steps of:

guiding a paper web to the carrier roll and wrapping the paper web over a portion of the circumference of the carrier roll and further guiding the paper from the carrier roll onto at least one winding reel;

forming on the paper web a tearing line running transversely across the paper web and applying an adhesive to the paper web ahead of the tearing line, in a manner that allows the paper web to adhere to the winding reel, machine speed being reduced from a normal speed which prevails before the web is provided with the tearing line and with the adhesive, the tearing line and the adhesive provided to the paper web with the paper web running at a reduced creep speed (k) and with a weakening device extending over the entire web width;

rotating the carrier roll at a speed such that it moves approximately synchronously with the paper web, both during a normal speed mode used during a normal operation and during creep speed (k) used during the election of the winding reel, so that there is no speed difference between the paper web and a cover surface of the carrier roll; and severing the web at the tearing line by the process of ejecting the winding reel from the winding machine when the web region containing the adhesive has reached a contact point of the winding reel on the carrier roll.

2. A method of changing a reel in a paper winding machine which includes at least one carrier roll, said paper winding machine operating at a normal speed (V), the method comprising the steps of:

guiding a paper web to the carrier roll and wrapping the paper web over a portion of the circumference of the carrier roll and further guiding the paper from the carrier roll onto at least one winding reel;

forming on the paper web a tearing line running transversely across the paper web and applying an adhesive to the paper web ahead of the tearing line, in a manner that allows the paper web to adhere to the winding reel, machine speed being reduced from a normal speed which prevails before the web is provided with the tearing line and with the adhesive, the tearing line and the adhesive provided to the paper web with the paper web running at a reduced creep speed (k) and with a weakening device extending over the entire web width;

rotating the carrier roll at a speed such that it moves approximately synchronously with the paper web, both during a normal speed mode used during a normal operation and during creep speed (k) used during the ejection of the winding reel, so that there is no speed difference between the paper web and a cover surface of the carrier roll; and severing the web at the tearing line by the process of ejecting the winding reel from the winding machine, wherein the at least one carrier roll includes first and second carrier rolls, which form between them a winding bed for accepting and supporting the winding reel, in which the web is guided into the winding bed from below and over the first carrier roll, and including ejecting the winding reel when that region of the web provided with the adhesive has reached a contact point of the winding reel on the first carrier roll.

3. A method of changing a reel in a paper winding machine which includes at least one carrier roll, said paper winding machine operating at a normal speed (V), the method comprising the steps of:

guiding a paper web to the carrier roll and wrapping the paper web over a portion of the circumference of the carrier roll and further guiding the paper from the carrier roll onto at least one winding reel;

forming on the paper web a tearing line running transversely across the paper web and applying an adhesive to the paper web ahead of the tearing line, in a manner that allows the paper web to adhere to the winding reel, machine speed being reduced from a normal speed which prevails before the web is provided with the tearing line and with the adhesive, the tearing line and the adhesive provided to the paper web with the paper web running at a reduced creep speed (k) and with a weakening device extending over the entire web width;

rotating the carrier roll at a speed such that it moves approximately synchronously with the paper web, both during a normal speed mode used during a normal operation and during creep speed (k) used during the election of the winding reel, so that there is no speed difference between the paper web and a cover surface of the carrier roll; and severing the web at the tearing line by the process of ejecting the winding reel from the winding machine, wherein the at least one carrier roll includes first and second carrier rolls, which form a winding bed for accepting and supporting the winding reel, in which the web is guided into the winding bed over an upper region of the first carrier roll, and including ejecting the winding reel when that region of the web provided with adhesive has reached a contact point of the winding reel on the second carrier roll.

4. A method for severing a paper web during a reel change in a winding machine having three carrier rolls, which form with one another first and second winding beds for accepting a respective winding reel including a first reel and a second reel, provided for reeling different web sections of the paper web, the method comprising the steps of:

forming simultaneously a first tearing line extending transversely over the entire web width including all the web sections;

at a predetermined distance downstream of the first tearing line, providing a second tearing line which likewise extends over the entire web width;

setting the distance between the first and second tearing lines when they reach the winding beds to be approximately equal to the difference between a first web running path ($L_1$) and a second web running path ($L_2$), where $L_1$ extends from a weakening device which forms the tearing lines to the location of the first winding bed and $L_2$ extends from the weakening device to the location of the second winding bed.

5. The method as claimed in claim 4, in which, during the ejection of the first reel from the first winding bed, a first outer carrier roll is stopped by a braking device and wherein, during the ejection of the second reel from the second winding bed, the second outer carrier roll is freely rotatable.

6. A method of changing a reel in a paper winding machine which includes at least one carrier roll, said paper winding machine operating at a normal speed (V), the method comprising the steps of:

guiding a paper web to the carrier roll and wrapping the paper web over a portion of the circumference of the carrier roll and further guiding the paper from the carrier roll onto at least one winding reel;

forming on the paper web a tearing line running transversely across the paper web and applying an adhesive to the paper web ahead of the tearing line, in a manner that allows the paper web to adhere to the winding reel, machine speed being reduced from a normal speed which prevails before the web is provided with the tearing line and with the adhesive, the tearing line and the adhesive provided to the paper web with the paper web running at a reduced creep speed (k) and with a weakening device extending over the entire web width;

rotating the carrier roll at a speed such that it moves approximately synchronously with the paper web, both during a normal speed mode used during a normal operation and during creep speed (k) used during the election of the winding reel, so that there is no speed difference between the paper web and a cover surface of the carrier roll; and severing the web at the tearing line by the process of ejecting the winding reel from the winding machine, wherein the paper web has a plurality of web sections and including:

jointly providing all web sections with a first tearing line (8'), which extends transversely over the entire web width;

at a specific distance downstream thereof, all web sections being provided with a second tearing line (8"), which likewise extends over the entire web width; and the distance between the two tearing lines (8' and 8") at the winding beds being at least approximately equal to the difference between a web running path from a weakening device which forms tearing lines to a contact point of a first reel on the carrier roll and a web running path from the weakening device to the contact point of a second reel on the carrier roll.

* * * * *